US010895103B2

(12) United States Patent
Alkhoury et al.

(10) Patent No.: US 10,895,103 B2
(45) Date of Patent: Jan. 19, 2021

(54) MODULAR THRESHOLD ASSEMBLY

(71) Applicants: Paul Boulos Alkhoury, Mount Albert (CA); Marcello Toppan, Toronto (CA)

(72) Inventors: Paul Boulos Alkhoury, Mount Albert (CA); Marcello Toppan, Toronto (CA)

( * ) Notice: Subject to any disclaimer, the term of this patent is extended or adjusted under 35 U.S.C. 154(b) by 168 days.

(21) Appl. No.: 15/952,198

(22) Filed: Apr. 12, 2018

(65) Prior Publication Data

US 2018/0298677 A1 Oct. 18, 2018

Related U.S. Application Data

(60) Provisional application No. 62/485,149, filed on Apr. 13, 2017.

(51) Int. Cl.
*E06B 7/14* (2006.01)
*E06B 1/70* (2006.01)

(52) U.S. Cl.
CPC . *E06B 7/14* (2013.01); *E06B 1/70* (2013.01)

(58) Field of Classification Search
CPC ..... E06B 1/70; E06B 7/14
See application file for complete search history.

(56) References Cited

U.S. PATENT DOCUMENTS 582,451 A * 5/1897 Brannon ..... E06B 1/70 49/471
719,672 A * 2/1903 Jewell ..... E06B 1/70 49/471
1,207,827 A * 12/1916 Winters ..... E06B 1/70 49/467
1,795,853 A * 3/1931 Hughe ..... E06B 7/232 49/470
2,089,380 A * 8/1937 Kammerer ..... E06B 1/70 49/468
4,055,917 A 11/1977 Coller
4,310,991 A * 1/1982 Seely ..... E06B 1/70 49/470
4,831,779 A * 5/1989 Kehrli ..... E06B 1/70 49/380
5,018,307 A 5/1991 Burnous et al.
5,067,279 A * 11/1991 Hagemeyer ..... E06B 1/70 49/470
5,179,804 A * 1/1993 Young ..... E06B 1/70 49/468
5,687,508 A * 11/1997 Fitzhenry, Jr. ..... E06B 1/70 49/380
5,943,825 A 8/1999 Procton et al.
5,956,909 A 9/1999 Chou
6,052,949 A 4/2000 Procton et al.
7,669,369 B2 * 3/2010 Henry ..... E06B 1/70 49/408

(Continued)

*Primary Examiner* — Catherine A Kelly
(74) *Attorney, Agent, or Firm* — Steven A. Nielsen; www.NielsenPatents.com

(57) ABSTRACT

Disclosed is a modular threshold assembly having a frame, a cover plate detachably attached to the frame at the first end of the frame first wall and the first end of the frame second wall and an elongate body detachably attached to the frame and being proximate to the frame first wall. Also, disclosed is door frame having the modular threshold assembly. The threshold assembly can permit replacement of different components of the modular assembly, while permitting water or moisture to be expelled to the exterior.

21 Claims, 5 Drawing Sheets

(56) References Cited

U.S. PATENT DOCUMENTS

| | | | | |
|---|---|---|---|---|
| 8,033,056 | B2 | 10/2011 | Wernlund et al. | |
| 8,230,646 | B2 * | 7/2012 | McDaniel | E06B 3/4636 49/467 |
| 8,448,384 | B2 * | 5/2013 | Wernlund | E06B 1/70 49/471 |
| 8,567,128 | B2 * | 10/2013 | Van Camp | E06B 1/70 49/468 |
| 8,683,747 | B2 * | 4/2014 | Kim | E06B 1/04 49/404 |
| 9,127,503 | B2 * | 9/2015 | Petta | E06B 1/70 |
| 9,371,682 | B2 | 6/2016 | Van Camp et al. | |
| 9,816,310 | B2 * | 11/2017 | Haynes | E05B 17/0075 |
| 10,370,891 | B2 * | 8/2019 | Farahmandpour | E06B 7/14 |
| 2009/0165406 | A1 * | 7/2009 | Campbell | E06B 1/70 52/211 |
| 2013/0199102 | A1 * | 8/2013 | Rager-Frey | E06B 1/70 49/469 |
| 2015/0096235 | A1 * | 4/2015 | Rochman | E06B 1/70 49/470 |
| 2016/0273260 | A1 * | 9/2016 | Jolie | E06B 1/70 |
| 2017/0298676 | A1 * | 10/2017 | Wilhelm | E05D 15/0665 |

* cited by examiner

*Exterior face view of a fully assembled door*

MODULAR THRESHOLD ASSEMBLY

FIELD

The disclosure relates to a modular threshold assembly and a door frame assembly having a modular threshold assembly.

BACKGROUND

With recent building code requirements and a harmonized North American standard for windows and doors, just like windows, doors are now required to meet strict requirement when it comes to water infiltration under a specified pressure difference, which are more stringent than those that previously existed. In addition, during construction or use of the area of a door frame, the threshold can get damaged requiring costly repair.

U.S. Pat. No. 7,669,369 relates to a door threshold water return system having a lower sill, an upper sill, a rear wall and a front wall forming a chamber, wherein at least one baffle is provided projecting into the chamber from the rear wall. A first gap is provided in proximity to the rear wall and between the upper sill and the rear wall, and a second gap is provided in proximity to the lower sill and between the lower sill and the front wall, whereby water introduced into the system through the first gap exits the system through the second gap.

U.S. Pat. No. 4,310,991 relates to a sealing system for an entry door that incorporates a threshold member having a longitudinally extending open-ended channel in its upper surface. The sweep utilizes a double vertical seal design which encloses the channel when the door is shut. The first seal contacts exterior portions of the channel whereas the second seal contacts interior portions of the channel. The channel is vented through the threshold so that the pressure on both sides of the first seal is equalized to minimize water seepage, while the second seal completely blocks the outside air from the interior of the building. The threshold is preferably of a two piece construction which may be snapped together to thereby minimize manufacturing and installation costs.

U.S. Pat. No. 5,943,825 relates to a building entryway system with a high degree of modularity to accommodate active inswing doors or inactive sidelight panels for use with conventional jambs. Specifically, an extruded aluminum sill is mated with an extruded polymeric receiving unit. The receiving unit defines a U-shaped channel which accepts a weather strip or panel cap. Either the weather strip or panel cap is slidably positioned within the channel under the door. Additionally a door sweep attached to the active doors sealingly engages the weather strip to prevent water from entering the building.

U.S. Pat. No. 9,127,503 relates to a sill assembly for a door frame, and includes a sub sill extending along a generally horizontal sill axis. The sub sill includes a sub sill upper portion. A base sill extends along the sill axis. The base sill is mounted to the sub sill and clads at least a portion of the sub sill upper portion. The base sill includes at least one base sill clip member. A step sill extends along the sill axis. The step sill includes an axially extending step sill upper surface positioned above the base sill, and at least one step sill clip member removably engaged with the base sill clip member to removably mount the step sill to the base sill.

There is a need in the art for a modular threshold assembly that can be easily assembled in the door frame and where the different modules can be replaced with easily removal of the a module and without requiring major disassembly of the threshold.

SUMMARY

In one aspect, the disclosure relates to a modular threshold assembly having:

a frame having a frame first wall and a frame second wall coupled proximate to or at opposing ends of a base; the frame first wall having a first end being distal from the base and the frame second wall having a first end being distal from the base;

a cover plate detachably attached to the frame at the first end of the frame first wall and the first end of the frame second wall, the cover plate having a downward slope from the frame first wall to the frame second wall; and an elongate body detachably attached to the frame and being proximate to the frame first wall, the elongate body being adapted for positioning under a door slab.

In another aspect, the disclosure relates to a door frame assembly having a pair of jambs coupling a head at a jamb first end and to a modular threshold assembly at jamb second end, a stop coupled to at least one of the jambs and a door slab coupled to the one of the jambs, the modular threshold assembly comprising:

a frame having a frame first wall and a frame second wall coupled proximate to or at opposing ends of a base; the frame first wall having a first end being distal from the base and the frame second wall having a first end being distal from the base;

a cover plate detachably attached to the frame at the first end of the frame first wall and the first end of the frame second wall, the cover plate having a downward slope from the frame first wall to the frame second wall; and an elongate body detachably attached to the frame and being proximate to the frame first wall, the elongate body being adapted for positioning under a door slab.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
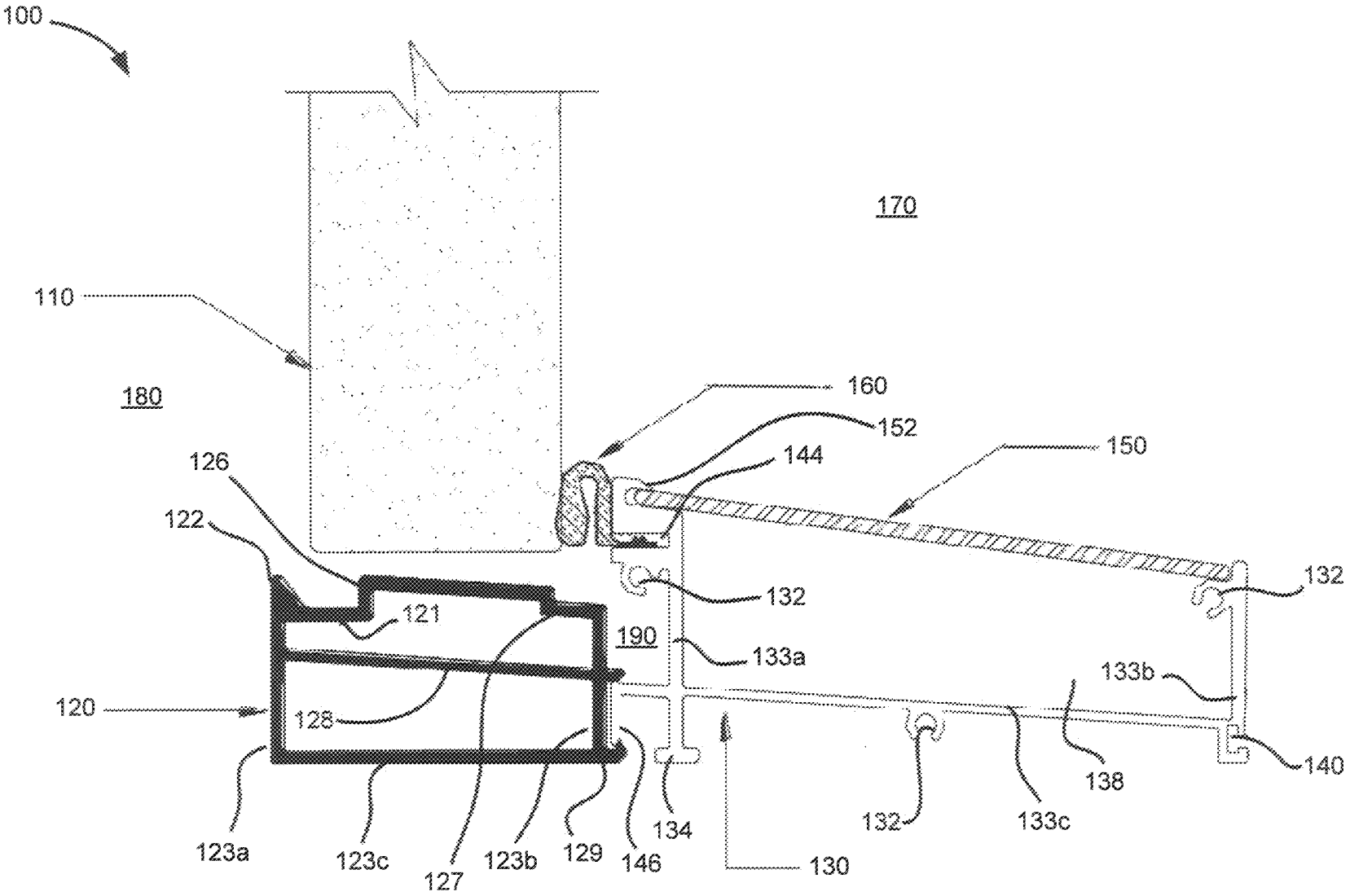
FIG. 1 is a side cross-section view of a door threshold assembly in accordance with an embodiment disclosed herein.
Figure 2:
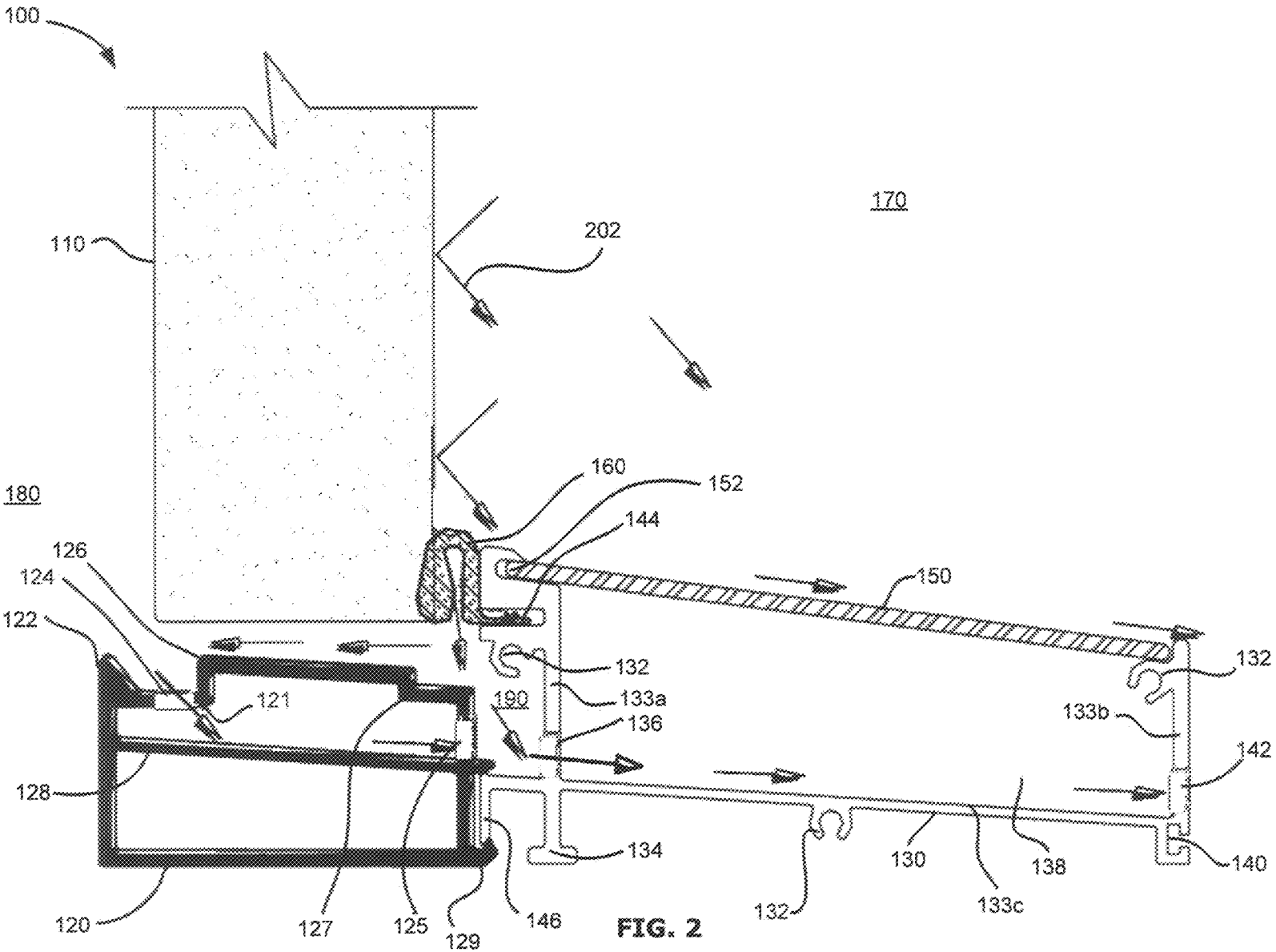
FIG. 2 is a side cross-section view of a door threshold assembly showing the flow of moisture towards the exterior.

Referring to FIGS. 1 and 2 which disclose a cross-section of a modular threshold assembly 100 in accordance with an embodiment of this disclosure. The modular threshold assembly 100 is made up of an elongated body 120 detachably attached to a frame 130. Also provided is a cover plate 150 detachably attached to the frame 130. The modular design can help with removal of components that may be more likely to become damaged, such as the cover plate 150, frame 130 or elongated body 120. Depending on locations and environmental conditions such as wind load, the door assembly is often under a negative pressure difference creating vacuum, forcing water to leak inside.

In one embodiment as disclosed in FIGS. 1 and 2, the frame 130 has a base 133*c* that extends away from a door slab 110. In one embodiment, for example and without limitation, as shown in FIGS. 1 and 2, the base 133*c* can provide a sloped surface that slopes downwardly towards the ground, as it extends away from the door slab 110. The sloped surface can help with drainage of any water that accumulates within the threshold assembly 100, as described herein.

The base 133*c* of the frame 130 does not necessarily need to be in contact with the ground on which it is positioned. Rather, as shown in FIGS. 1 and 2, the base 133*c* can be provided with upstanding walls (133*a*, 133*b*), which in one embodiment, for example and without limitation, are provided with feet 134 that help to raise the base 133*c* above the ground as well as provide the sloped decline for the base 133*c*. The base 133*c* has a first end that is proximate to the door slab 110 and elongated body 120, and an opposing end that is distal from the door slab 110 and elongated body 120.

In one embodiment, as shown in FIGS. 1 and 2, for example and without limitation, the frame 130 can be provided with a first wall 133*a* and a second wall 133*b*, both of which are coupled to and extend from the base 133*c*. The position of the walls (133*a*, 133*b*) is not particularly limited and can be varied depending upon the design and application requirements. In one embodiment, as shown in FIGS. 1 and 2, the first wall 133*a* is positioned close to the first end of the base 133*c*, and hence, is also proximate to the door slab 110 and elongated body 120; while the second wall 133*b* is positioned close to the second end of the base 133*c*, and hence, is also distal from the door slab 110 and elongated body 120.

The length of the walls (133*a*, 133*b*) is not particularly limited and can be varied depending upon design and application requirements. In one embodiment, for example and without limitation, as shown in FIGS. 1 and 2, the first wall 133*a* is taller than the second wall 133*b*. In addition, as shown in FIGS. 1 and 2, for example and without limitation, the walls can extend both above and below the surface of the base 133*c*. For example, the first wall 133*a* extends both above and below the surface of the base 133*c*, while the second wall 133*b* only extends above the surface of the base 133*c*.

Figure 3:
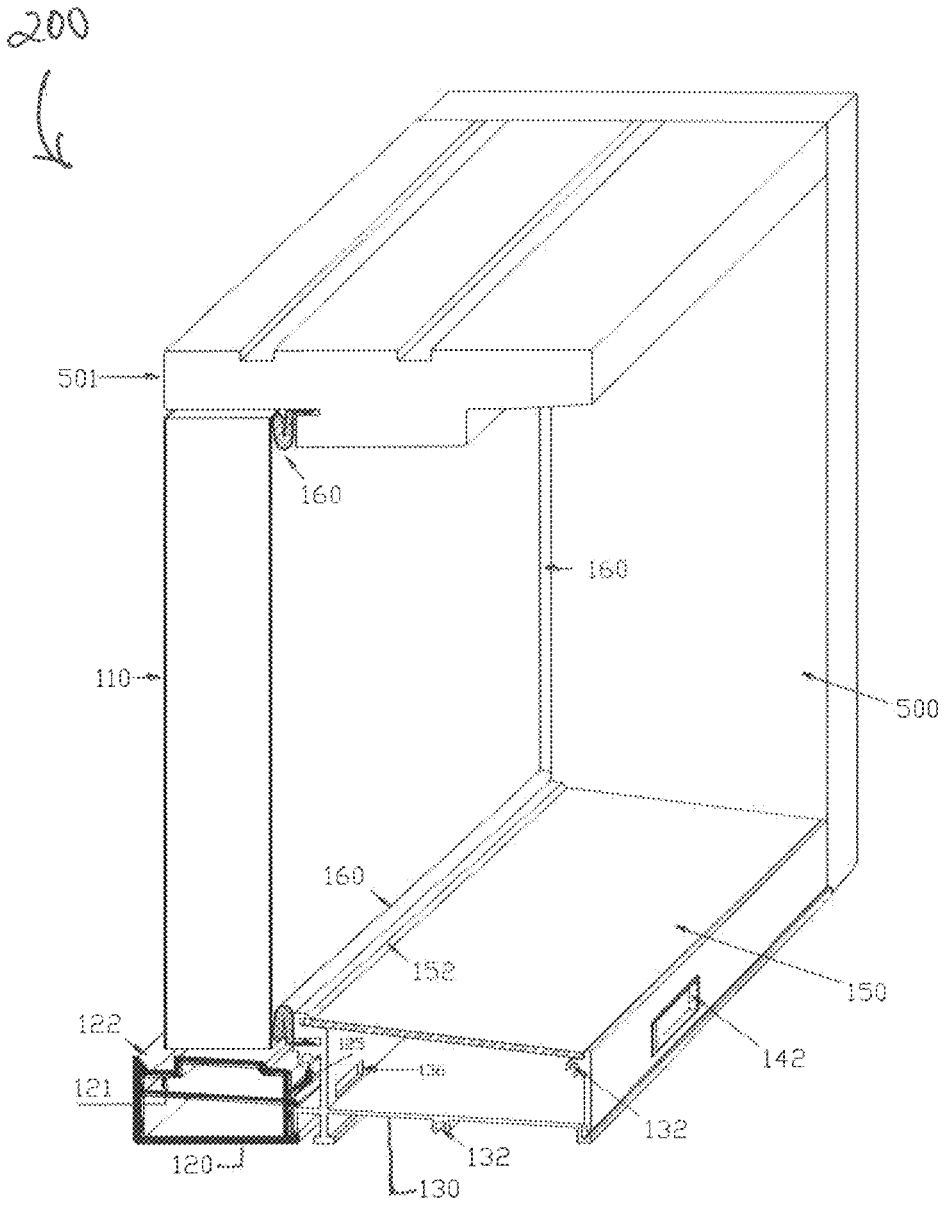
FIG. 3 shows a cross-section of a door frame assembly in accordance with an embodiment disclosed herein.
Figure 4:
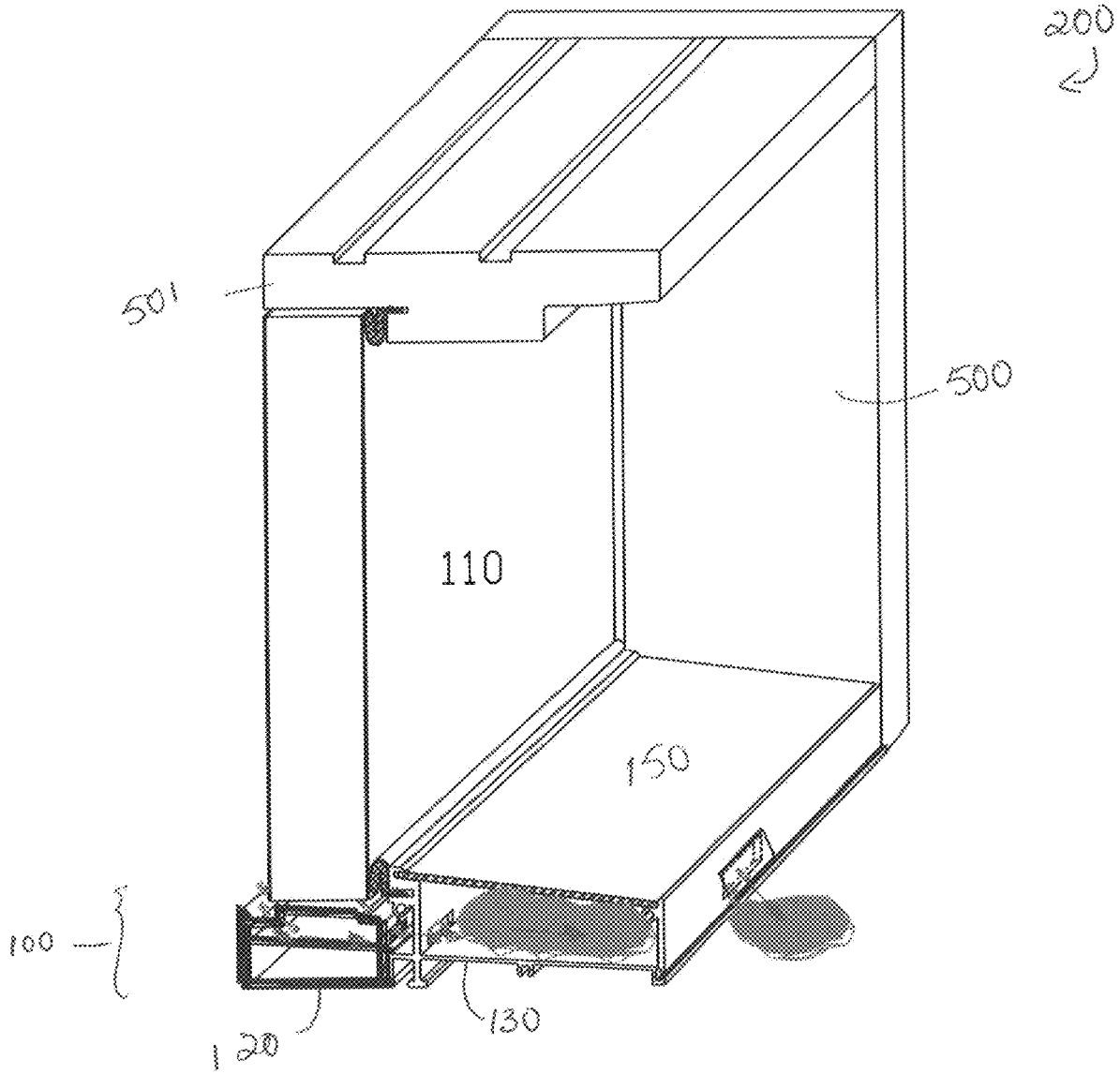
FIG. 4 shows a cross-section of a door frame assembly showing the flow of moisture towards the exterior.
Figure 5:
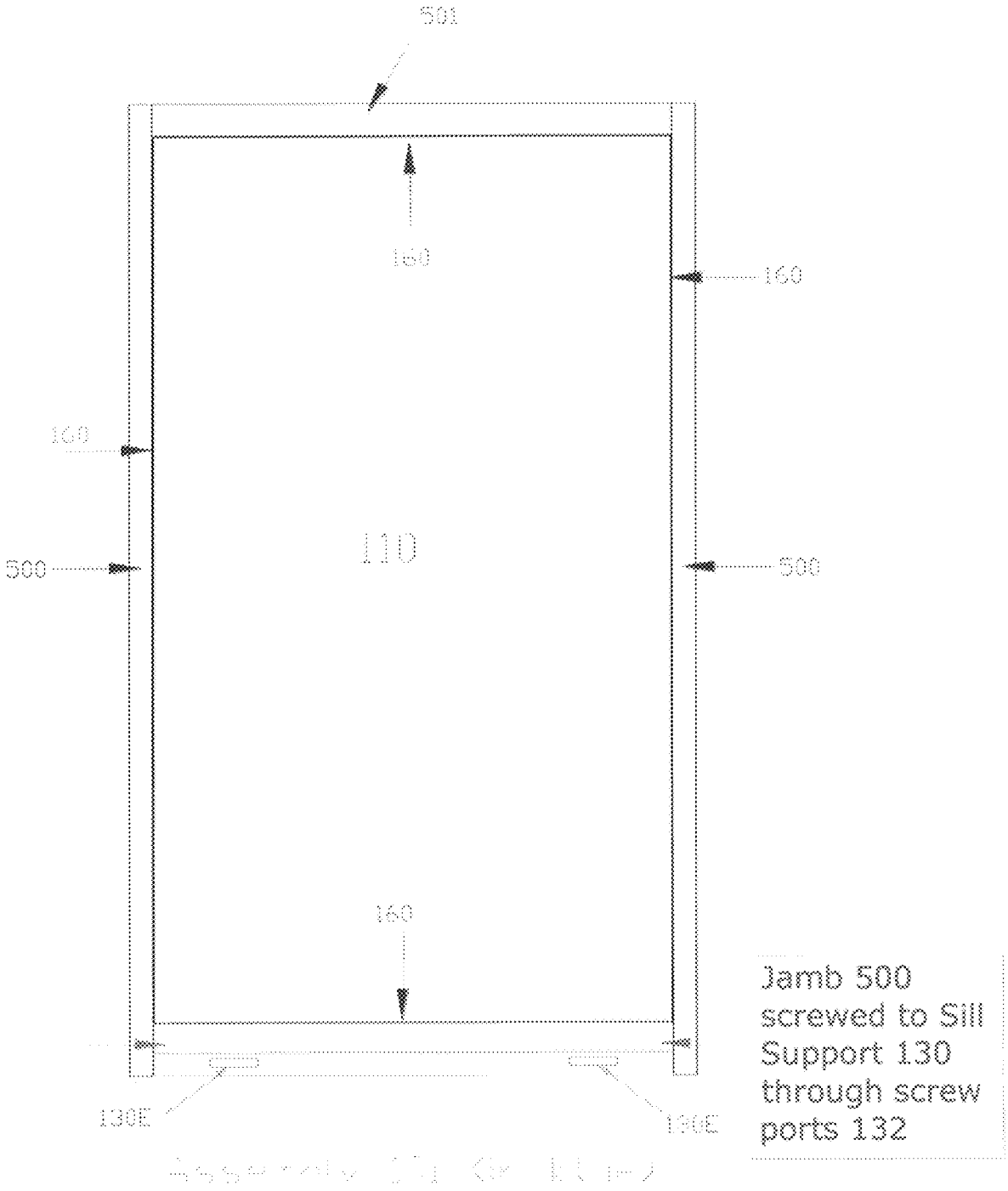
FIG. 5 shows a plan view of a door frame assembly having the threshold assembly disclosed herein.

In one embodiment, for example and without limitation, as described above, the first wall 133*a* portion that extends below the surface of the base 133*c* can be provided with a foot 134 that can be positioned on the ground surface. In contrast, the surface of the base 133*c* below the second wall 133*b* can be provided with a retaining feature 140 to help affix the base 133*c* to the ground surface or the door frame assembly 200 (as shown in FIGS. 3-5). By modulating the height of the wall (133*a*, 133*b*) below the surface of the base 133*c*, the slope angle of the base 133*c* can be established. In the embodiment shown in FIGS. 1 and 2, the height of the first wall 133*a* below the base 133*c* is greater than the combined height of the second wall 133*b* below the surface of the base 133*c* and the retaining feature 140 positioned close to the second end of the base. This results in the first end of the base being positioned higher than the second end of the base, and thereby resulting in the desired slope for water drainage, as described herein.

In one embodiment, as shown in FIGS. 1 and 2, the overall height of the first wall 133*a* is also greater than the overall height of the second wall 133*b*. In addition, the first wall 133*a* has a first end that is distal from the base 133*c* and opposed to the end of the first wall 133*a* that has the feet 134. Similarly, the second wall 133*b* has a first end that is also distal from the base 133*c* and the ground on which the frame 130 is positioned. Due to the height differences between the first wall 133*a* and the second wall 133*b*, relative to the ground on which the frame 130 is placed, the first end of the first wall 133*a* is higher than the first end of the second wall 133*b*.

The threshold assembly 100 is provided with a cover plate 150 that is positioned at the first end of the first wall 133*a* and the first end of the second wall 133*b*. The aspects of the cover plate 150 disclosed herein are not particularly limited and can be varied depending upon the design and application requirements. The cover is wide enough that it extends from the first end of the first wall 133*a* to the first end of the second wall 133*b*. As shown in FIGS. 1 and 2, the cover plate 150 when positioned on the first end of the first wall 133*a* to the first end of the second wall 133*b* has a downward slope, due to the height differences between the first wall 133*a* and the second wall 133*b*. Thus, the end of the cover plate 150 close to the door slab 110 or the elongated body 120 is higher off the ground surface than the end of the cover plate 150 close to the second wall 133*b*. The downward slope angle of the cover plate 150 is not particularly limited and can be varied depending upon design and application requirements. In one embodiment, as shown in FIGS. 1 and 2, the downward slope angle of the cover plate 150 is greater than the downward slope angle of the base 133*c*.

In one embodiment, the cover plate 150 is detachably attached to the first end of the first wall 133*a* and the first end of the second wall 133*b*. The phrase 'detachably attached' as used herein relates to, for example and without limitation, the cover plate 150 being affixed to the frame 130, however, the cover plate 150 can be removed and replaced with another cover plate that can be coupled to the frame 130 without significantly damaging or destroying the frame 130 or the cover plate 150 that is removed.

The method for detachably attaching the cover plate 150 to the frame 130 is not particularly limited, and can be varied depending upon the design and application requirements. In one embodiment, for example and without limitation, as shown in FIGS. 1 and 2, the first end of the first wall 133*a* has a retention slot 152 that can receive an end of the cover plate 150. The shape of the retention slot 152 formed in the first wall 133*a* is not particularly limited. In one embodiment, as shown in FIGS. 1 and 2, the retention slot 152 is formed by having a generally U-shaped attached at the first end of the first wall 133*a*. One end of the cover plate 150 can be inserted into the retention slot 152 to fixedly hold and retain the cover plate 150 to the frame 130.

As shown in FIGS. 1 and 2, in one embodiment, for example and without limitation, the opposing end of the cover plate 150, which is distal from the first wall 133*a* and the door slab 110, can be positioned and detachably attached at the first end of the second wall 133*b*. The method for attaching the end of the cover plate 150 to the second wall 133*b* is not particularly limited and can be varied depending upon the design and application requirements. In one embodiment, for example and without limitation, the cover plate 150 is frictionally fitted between the retention slot 152 and the second wall 133*b*. In a further embodiment, the side (inner side) of the second wall 133*b* that faces the first wall 133*a* can be provided with a protuberance to allow the cover plate 150 to sit thereon. In the embodiment shown in FIGS. 1 and 2, the inner side of the second wall 133*b* is provided with screw port receptacle 132, which is positioned on the inner side of the second wall 133*b* to allow the cover plate to rest on the screw port receptacle 132, while also being affixed in place by the retention slot 152 in the first wall 133*a* and the second wall 133*b*.

As should be recognized by a person of skill in the art, the method of retaining the cover plate 150 to the frame 130 disclosed are exemplary only and can be varied. For example, and without limitation, the U-shaped retention member 152 that is be disclosed herein as being present on the first wall 133*a*, can be provided on the second wall 133*b*, while the end of the cover plate 150 close to the door slab 110 is frictionally fit at the first end of the first wall 133*a*.

The frame 130 can be provided with additional features as required for installation of the threshold assembly 100. In one embodiment, for example and without limitation, the frame 130 can be provided with additional screw port receptacles 132 for affixing the frame 130 in place on the ground surface or for coupling to the door frame assembly 200. The one or more screw port receptacles can be present on the first wall 133*a*, the second wall 133*b* and the base 133*c*.

Once the frame 130 and the cover plate 150 are assembled, an interior space 138 in the frame 130 is provided where moisture or water can collect and drain from, as described herein.

In another embodiment, for example and without limitation, the first wall 133*a* of the frame 130 has a groove 144 for receiving and attaching a sealing member 160, which comes in contact with the door slab 110 when the door is closed, and can help provide a seal to prevent water or moisture ingress from below the door slab 110. The sealing member 160 disclosed herein is not particularly limited and can be varied depending upon design and application requirements. Furthermore, such sealing members 160 should be known to a person of skill in the art.

In a further embodiment as disclosed herein, the first wall 133*a* of the frame 130 and the second wall 133*b* of the frame 130 are provided with apertures 136, 142 to allow moisture or water to flow from the first wall 133*a* of the frame 130 to the second wall 133*b* of the frame 130. As the water or moisture flows from the first wall 133*a* to the second wall 133*b* of the frame 130, it exits the threshold assembly 100 from the aperture 142 provided in the second wall 133*b* of the frame 130. The first wall 133*a* and the second wall 133*b* of the frame 130 can be provided with flaps or one-way valves, as should be known to a person of skill in the art, to inhibit or prevent backwards flow of the moisture or water from the second wall 133*b* of the frame 130 to the elongated body 120, as described herein. Further, once the moisture or water exits the frame 130 from the aperture in the second wall 133*b* of the frame 130, the flap or valves can prevent moisture or water from re-entering the frame 130.

The threshold assembly 100 is also provided with an elongate body 120 that is coupled to the frame 130 at or near the end of the frame 130 having the first wall 133*a*. The elongate body 120 is positioned underneath the door slab 110 when the door slab 110 is in the closed position, and extends from one door jamb 500 to an opposing door jamb 500 in the door frame assembly 200.

In one embodiment, as disclosed in FIGS. 1 and 2, the elongate body 120 has an elongate body first wall 123*a* and an elongate body second wall 123*b* at opposing ends of an elongate body first surface 126 and an elongate body second surface 128. As shown in FIGS. 1 and 2, the elongate body first wall 123*a* and the elongate body second wall 123*b* extend generally vertically from the ground surface to the door slab 110, while the elongate body first surface 126 and the elongate body second surface 128 are slightly sloped or near parallel to the ground surface on which the threshold assembly 110 is placed. In a further embodiment, for example and without limitation, as shown in FIGS. 1 and 2, the elongate body 120 is also provided with an elongate body floor surface 123*c* that can be in contact with the floor surface, with the elongate body first wall 123*a* and the elongate body second wall 123*b* extending upright from the elongate body floor surface 123*c*.

As shown in FIGS. 1 and 2, the elongate body second wall 123*b* is positioned to be closer to the frame first wall 133*a* than the elongate body first wall 123*a*. In other words, when the threshold assembly 100 is formed, the elongate body second wall is positioned in between the frame first wall 133*a* and the elongate body first wall 123*a*.

As shown in FIGS. 1 and 2, the elongate body first surface 126 is further away from the ground surface than the elongate body second surface 128. Stated another way, when the threshold assembly 100 is formed, the elongated body first surface 126 is in a first plane and the elongate body second surface 128 is in a second plane, with the first plane being closer to the cover plate 150 than second plane. In a particular embodiment, as shown in FIGS. 1 and 2, the elongate body first surface 126 is spaced apart from the door slab 110 to provide a passage to facilitate water or moisture flow from an interior side 180 to an exterior side 170, as described herein.

To assemble the threshold assembly and in particular, to couple the elongate body 120 to the frame 130, the elongate body second wall 123*b* and the frame 130 can be provided with features to detachably attach the elongate body 120 to the frame 130. In one embodiment, as shown in FIGS. 1 and 2, the elongate body second wall 123*b* is provided a receptacle 129 on the side of the elongate body second wall 123*b* that faces the frame 130. To couple the frame 130 to the elongate body 123*b*, the frame 130 can be provided with a projection 146 that is received within the receptacle 129 in the elongate body second wall 123*b*.

The position of the receptacle 129 on the elongate body second wall 123*b* and the projection 146 in the threshold assembly 100 is not particularly limited and can be varied depending upon the design and application requirements; so long as they are positioned to allow the projection 146 to be engaged in the receptacle 129, and detachably attach the frame to the elongate body 120. In one embodiment, as shown in FIGS. 1 and 2, the receptacle 129 is formed on the surface of the elongate body second wall 123*b* facing the frame 130 by allowing the elongate body second surface 128 and the elongate body floor surface 123*c* to extend beyond the elongate body second wall 123*b* towards the frame 130. However, the protuberances on the elongate body second wall 123*b* that extend towards the frame 130, and formed by the elongate body second surface 128 and the elongate body floor surface 123*c* can be off-set, so long as they are aligned with the projection 146 and allow water or moisture flow to exit the threshold assembly 100, as disclosed herein. In a further particular embodiment, as shown in FIGS. 1 and 2, the protuberances formed by the elongate body second surface 128 and the elongate body floor surface 123*c* that extend towards the frame 130 can be provided with a lip to assist with detachably attaching the projection 146 within the receptacle 129.

As shown in FIGS. 1 and 2, the projection 146 extends from the frame first wall 133*a* towards the elongate body 120. In a particular embodiment, for example and without limitation, the projection 146 lies in the same plane as the base 133*c* of the frame 130 and detachably attaches to the receptacle 129 to affix in position the frame 130 to the elongate body 120. In a further embodiment, the projection is frictionally fit within the receptacle 146. The shape of the projection is not particularly limited and can be varied depending upon the design and application requirements, so long as it can allow the frame 130 to detachably attach to the elongate body 120. In a particular embodiment, as shown in FIGS. 1 and 2, the projection 146 is provided with an arm that engages the lip in the receptacle to affix the projection 146 in the receptacle 129.

In one embodiment, as shown in FIGS. 1 and 2, the elongate body first surface 126 can be provided with a recess 121 that is positioned close to the elongate body first wall 123*a*. The recess 121 present is in a plane that is closer to the ground surface than the elongate body first surface 126. In a further embodiment, as shown in FIGS. 1 and 2, the recess extends from the elongate body first wall 123*a*. The recess can be provided with an opening 124 to allow water and moisture flow to the interior of the elongate body 120, and flow from there to the exterior 170 and outside of the threshold assembly 100, as disclosed herein.

As shown in FIGS. 1 and 2, in one embodiment, the elongate body first wall 123*a* is positioned to be more interior than the door slab 110. In other words, the plane having the interior surface of the door slab 110 is closer to the frame 130 than the plane having the elongate body first wall 123*a*. In a particular embodiment, as shown in FIGS. 1 and 2, the inner surface of the elongate body first wall 123*a* can be provided with a sloped surface at an end of the elongate body first wall 123*a* close to the door slab 110. The sloped surface can be formed by a protrusion 122 extending from the elongate body first wall 123*a*. Such features can assist with water and moisture drainage to the exterior 170, as described herein.

In one embodiment, as shown in FIGS. 1 and 2, the elongate body first surface 126 can be provided with a ledge 127. In a particular embodiment, the step from the ledge 127 to the elongate body first surface 126 is aligned with the exterior surface of the door slab 110 to further assist with the water or moisture drainage. In a further embodiment, the elongate body first surface 126 and/or the elongate body second surface 128 has a downward slope from the interior 180 to the exterior 170. In other words, the portion of the elongate body first surface 126 and the elongate body second surface 128 close to the elongate body first wall 123*a* is further away from the ground surface than the portion of the elongate body first surface 126 and the elongate body second surface 128 close to the elongate body second wall 123*b*. These features can assist with water or moisture drainage as described herein.

FIG. 2 shows a schematic of flow of moisture or water (see arrows 202) through the threshold assembly 100. As moisture or water contacts the door slab 110 it flows downwardly due to gravity to the threshold assembly 100. As moisture or water contacts the sealing member 160 or the cover plate 150, the downward slope of the cover plate 150 assists in directing flow of the water or moisture away from the interior 180. If any moisture or water passes through the space between the door slab 110 and the sealing member 160 and flows towards the interior, the sloped elongate body first surface 126 assists in directing the moisture or water towards the interior space 190 between the elongate body 120 and the frame 130.

If the moisture or water moves further toward the interior 180 or contacts the interior surface of the door slab 110, the water or moisture can be directed to the recess 121 that is provided with an opening 124 to allow the moisture or water to pass into the interior of the elongate body 120. Once inside, due to the downward slope of the elongate body second surface 128, the water or moisture flows towards the elongate body second wall 123*b* that is provided with an aperture 125 to allow water or moisture to flow from the interior of the elongate body 120 and the interior space 190 to the interior of the frame 130, and from there to the interior 138 of the frame 130 through aperture 136 provided in the frame first wall 133*a*. The downward slope of the base 123*c* also directs the moisture or water towards the second wall 133*b* of the frame 130, which is also provided with an aperture 142 to allow the water or moisture to exit the threshold assembly 100.

FIGS. 3-5 disclose a door frame assembly 200 having a pair of jambs 500, a head 501, a door slab 110 and a threshold assembly 100 as disclosed herein. The features of the door frame assembly 200 relating to the jamb 500, head 501 and door slab 110 are not particularly limited and can be varied based on design and application requirements. In one embodiment, for example and without limitation, the jambs 500 can be screwed to the threshold assembly 100 by utilizing the screw port receptacles 132.

The door slab 110 may be constructed of suitable materials known in the art, for example and without limitation, door slabs 110 can be made of insulated steels, Aluminum extrusion, fiberglass or even wood. The material of construction for the threshold assembly disclosed herein is not particularly limited and can be made of the same or different materials; for example and without limitation, the threshold assembly can be made of a combination of various materials such as aluminum extrusion, vinyl extrusion, fiberglass and wood.

In one embodiment, for example and without limitation, the vertical jambs 500 are fastened to the frame 130 through screw ports 132. The elongate body 120 can snaps to the frame 130 and can allow for replacement in installed doors in case of damage. In addition, the elongate body 120 may form a continuous seal with the door jambs 160. The upper surface of the elongate body 120 may have a profile similar to that shown in FIGS. 1 and 4 such that a protrusion 122 located on the interior side 180 of the elongate body 120 directs any moisture deposited thereon into a recess 121 between the protrusion 122 and a raised portion (elongate body first surface) 126. The purpose of the protrusion 122 is to catch any water that may have leaked. Recess 121 allows for water to escape through apertures 124 that may be drilled. Elongate body second surface 128 is sloped outward to catch and direct any water draining from aperture 124. The elongate body first surface 126 may be sloped downward towards the exterior 170 to facilitate drainage of moisture towards the exterior 170. A sloped ledge 127 may be present on the exterior side of the elongate body 120 and located generally underneath the sealing member 160.

Although the description herein describes moisture, this terminology is not meant to be limiting. Moisture may mean ice, snow, liquid, mud, and/or other type of generally liquid matter.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

The thicknesses and dimensions depicted in the figures and described herein are meant to be illustrative and not restrictive. The figures may exaggerate or minimize the dimensions of these features for illustrative purposes and/or for ease of reference.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

What is claimed is:

1. A modular threshold assembly, comprising:

a frame having a frame first wall and a frame second wall coupled proximate to or at opposing ends of a base; the frame first wall having a first end being distal from the base and the frame second wall having a first end being distal from the base;

a cover plate detachably attached to the frame at the first end of the frame first wall and the first end of the frame second wall, the cover plate having a downward slope from the frame first wall to the frame second wall; and an elongate body detachably attached to the frame and being proximate to the frame first wall, the elongate body being adapted for positioning under a door slab, wherein the elongate body has an elongate body first wall and an elongate body second wall, the elongate body second wall positioned between the frame first wall and the elongate body first wall; a first surface extending from the elongate body first wall to the elongate body second wall; and a second surface extending from the elongate body first wall to the elongate body second wall; wherein the first surface is in a first plane and the second surface is in a second plane, the first plane being closer to the cover plate than second plane, and wherein the frame first wall has a projection extending towards the elongate body second wall, the elongate body second wall having a receptacle formed on a surface of the elongate body second wall facing the frame first wall, and the receptacle adapted for receiving the projection to detachably attach the elongate body to the frame.

2. The modular threshold assembly of claim 1, wherein the projection is frictionally fit in the receptacle.

3. The modular threshold assembly of claim 1, wherein the first surface has a recess proximate to the elongate body first wall, the recess having an opening permitting fluid flow to the second surface, the second surface having a downward slope from the elongate body first wall to the elongate body second wall.

4. The modular threshold assembly of claim 3, wherein the elongate body second wall has an elongate body second wall aperture, the frame first wall having a frame first wall aperture and the frame second wall having a frame second wall aperture;

wherein the elongate body second wall aperture, the frame first wall aperture and the frame second wall aperture being formed to permit fluid flow from the recess to exit the modular threshold assembly from the frame second wall aperture.

5. The modular threshold assembly of claim 1, wherein the first surface has a downward slope from the elongate body first wall to the elongate body second wall.

6. The modular threshold assembly of claim 1, wherein the first surface has a lowered ledge proximate and coupled to the elongated body second wall.

7. The modular threshold assembly of claim 3, wherein the elongate body first wall has a sloped projection directing fluid flow to the recess.

8. The modular threshold assembly of claim 1, wherein the frame first wall having a retention slot for receiving an end of the cover plate.

9. The modular threshold assembly of claim 1, wherein the base has a downward slope from the frame first wall to the frame second wall.

10. The modular threshold assembly of claim 1, further comprising a sealing member coupled to the frame first wall.

11. A door frame assembly having a pair of jambs coupling a head at a jamb first end and to a modular threshold assembly at jamb second end, a stop coupled to at least one of the jambs and a door slab coupled to the one of the jambs, the modular threshold assembly comprising:

a frame having a frame first wall and a frame second wall coupled proximate to or at opposing ends of a base; the frame first wall having a first end being distal from the base and the frame second wall having a first end being distal from the base;

a cover plate detachably attached to the frame at the first end of the frame first wall and the first end of the frame second wall, the cover plate having a downward slope from the frame first wall to the frame second wall; and an elongate body detachably attached to the frame and being proximate to the frame first wall, the elongate body being adapted for positioning under the door slab, wherein the elongate body has an elongate body first wall and an elongate body second wall, the elongate body second wall positioned between the frame first wall and the elongate body first wall; a first surface extending from the elongate body first wall to the elongate body second wall; and a second surface extending from the elongate body first wall to the elongate body second wall; wherein the first surface is in a first plane and the second surface is in a second plane, the first plane being closer to the cover plate than second plane, and wherein the frame first wall has a projection extending towards the elongate body second wall, the elongate body second wall having a receptacle formed on a surface of the elongate body second wall facing the frame first wall, and the receptacle adapted for receiving the projection to detachably attach the elongate body to the frame.

12. The door frame assembly of claim 11, wherein the elongate body first wall being in an elongate body first wall plane and an inner surface of the door slab being in an inner surface door slab plane, the inner surface door slab plane being in between the elongate body first wall plane and a plane having the elongate body second wall.

13. The door frame assembly of claim 11, wherein the projection is frictionally fit in the receptacle.

14. The door frame assembly of claim 11, wherein the first surface has a recess proximate to the elongate body first wall, the recess having an opening permitting fluid flow to the second surface, the second surface having a downward slope from the elongate body first wall to the elongate body second wall.

15. The door frame assembly of claim 14, wherein the elongate body second wall has an elongate body second wall aperture, the frame first wall having a frame first wall aperture and the frame second wall having a frame second wall aperture;

wherein the elongate body second wall aperture, the frame first wall aperture and the frame second wall aperture being formed to permit fluid flow from the recess to exit the modular threshold assembly from the frame second wall aperture.

16. The door frame assembly of claim 11, wherein the first surface has a downward slope from the elongate body first wall to the elongate body second wall.

17. The door frame assembly of claim 11, wherein the first surface has a lowered ledge proximate and coupled to the elongated body second wall.

18. The door frame assembly of claim 15, wherein the elongated body first wall has a sloped projection directing fluid flow to the recess.

19. The door frame assembly of claim 11, wherein the frame first wall having a retention slot for receiving an end of the cover plate.

20. The door frame assembly of claim 11, wherein the base has a downward slope from the frame first wall to the frame second wall.

21. The door frame assembly of claim 11, further comprising a sealing member coupled to the frame first wall.

* * * * *